US005263589A

United States Patent [19]

Patterson

[11] Patent Number: 5,263,589

[45] Date of Patent: Nov. 23, 1993

[54] METHOD OF RECOVERING TOBACCO FROM STEMMERY DISCARD

[75] Inventor: Everett C. Patterson, Midlothian, Va.

[73] Assignee: Philip Morris Incorporated, New York, N.Y.

[21] Appl. No.: 946,845

[22] Filed: Sep. 18, 1992

[51] Int. Cl.[5] ..... B07B 9/02

[52] U.S. Cl. ..... 209/32; 209/31; 209/139.2; 209/467; 209/303; 131/109.2

[58] Field of Search ..... 209/19, 30, 31, 33, 209/35, 37, 137, 139.1, 139.2, 143, 467, 303, 12, 17; 131/109.2, 109.3, 110, 312, 371

[56] References Cited

U.S. PATENT DOCUMENTS

| | | | |
|---|---|---|---|
| Re. 29,625 | 5/1978 | Summers | 209/469 |
| 1,457,110 | 5/1923 | Gay | 209/139.1 |
| 1,530,277 | 3/1925 | Mettler, Sr. | 209/137 |
| 2,755,930 | 7/1956 | Eissmann | 209/139.2 |
| 2,774,476 | 12/1956 | Doyle | 209/139.2 |
| 2,988,213 | 6/1961 | Davis et al. | 209/21 |
| 3,116,238 | 12/1963 | Etten | 209/250 |
| 3,136,321 | 6/1964 | Davis | 131/371 |
| 3,176,526 | 4/1965 | Fischer | 209/366 X |
| 3,219,185 | 11/1965 | Doyle | 209/139.2 |
| 3,360,125 | 12/1967 | Horsey | 209/143 X |
| 3,826,065 | 7/1974 | Labbe | 209/133 X |
| 4,150,750 | 4/1979 | Sawasky | 209/664 |
| 4,216,080 | 8/1980 | Summers et al. | 209/469 |
| 4,340,142 | 7/1982 | De La Burde et al. | 209/11 |
| 4,568,453 | 2/1986 | Lowe, Jr. | 209/137 X |
| 4,865,721 | 9/1989 | Smith et al. | 209/137 X |

FOREIGN PATENT DOCUMENTS 806161 2/1981 U.S.S.R. .

OTHER PUBLICATIONS

Brochure: "The Whirlwind Air Separator", Sturtevant, Inc. (Sep. 1988).

Brochure: "Multi-Aspirator", Kice Industries, Inc. (Nov. 1988).

Brochure: "Oliver", Oliver Manufacturing Co. (Oct. 1987).

Manual: "Stoner Operating Instructions Manual", Oliver Manufacturing Co. (0289/500).

Brochure: "bfGump Bar-Nun Screening Pressure and Atmospheric", Blaw-Knox.

Food & Chemical Equipment Co. (1982) Form No. S2K83.

*Primary Examiner*—Robert P. Olszewski

*Assistant Examiner*—Dean A. Reichard

*Attorney, Agent, or Firm*—Burns, Doane, Swecker & Mathis

[57] ABSTRACT

A stemmery discard of tobacco and soil particles is fed to an air/centrifugal separator in which a fraction of smaller tobacco particles is recovered with a low amount of soil. The residue from that separator is fed to a screen separator in which a fraction of larger tobacco particles is recovered with a low amount of soil. A residue from the rotary screen separator is fed to a gravity separator which recovers as much tobacco as possible without exceeding a preselected amount of soil. The screen separator may comprise a first separator screen to separate out a fraction of larger tobacco particles, and a second screen to separate out a fraction of smaller tobacco particles from the particles falling through the first screen; the particles retained by the second screen would be sent to the gravity separator, and the separated-out smaller particles would be discarded.

22 Claims, 3 Drawing Sheets

METHOD OF RECOVERING TOBACCO FROM STEMMERY DISCARD

BACKGROUND OF THE INVENTION

The present invention relates to the recovery of tobacco from a mixture of tobacco and non-tobacco particles and, in particular, to methods and apparatus for separating tobacco particles from soil particles in a stemmery discard.

In an effort to recover as much of the useful component of tobacco leaves as possible, the leaves are treated in stemmeries which remove leaf lamina from the stems by a series of threshing stages. This results in the production of tobacco fines or particles of a relatively wide range of small sizes, along with appreciable amounts of non-tobacco particles, especially soil particles such as dirt and sand which accompanied the stems to the stemmery. The mixture of tobacco particles, stems, and soil particles is subjected to a series of separation steps in the stemmery, usually involving vibratory reciprocal screens, in an effort to recover the larger tobacco particles, which can be used in the manufacture of tobacco products.

The residue of the final separating step comprises a mixture of very small tobacco particles and a large amount of soil particles. That mixture is unsuitable for use in the manufacture of tobacco products, due to the excessive contamination by soil particles. In particular, the abrasiveness of the soil particles, especially sand, would damage the tobacco processing equipment. Consequently, that mixture is discarded and sent to landfill.

It would, therefore, be desirable to recover tobacco particles from that stemmery discard, not simply to reduce tobacco waste and slow the rate of depletion of landfill space. However, the difficulties involved in recovering useful tobacco (i.e., tobacco accompanied by only a small amount of soil particles, such as less than twenty percent, and most preferably less than eight percent by weight) from stemmery discard has discouraged such recovery efforts. Among the reasons for these difficulties is the smallness of the tobacco particles which are difficult to separate from soil particles and which tend to clog or "blind" screen type separators. Also, since the tobacco particles, although small, occupy a relatively wide range of sizes and shapes, they are difficult to separate on the basis of density by conventional gravity-type separators.

Therefore, it would be desirable if an efficient and effective way could be found to recover tobacco from a stemmery discard in order to minimize both the amount of tobacco waste and the rate of depletion of landfill space.

SUMMARY OF THE INVENTION

The present invention involves a method of recovering tobacco particles from stemmery discard comprised of tobacco particles and soil particles. The stemmery discard is subjected to a first separation procedure for recovering a fraction of larger tobacco particles with a soil content of about 0–20 percent by weight. Then, the residual fraction from the first separation procedure is subjected to a second separation procedure for recovering a fraction of larger tobacco particles with a soil content of about 0–20 percent by weight. Then, at least a fraction of larger particles of the residual fraction from the second separation procedure is subjected to a third separation procedure for recovering tobacco particles with a soil content of about 0–20 percent by weight.

Preferably, in the first separation procedure, tobacco particles smaller than about 150 mesh, and most preferably 170 mesh, are recovered by introducing the stemmery discard into an upward air current which passes through a centrifugal force field.

In the second separation procedure, tobacco particles larger than about 40 mesh, and most preferably about 30 mesh, are recovered by means of a screen separator.

The third separation procedure is preferably performed by placing the residual fraction received from the second separation procedure onto an inclined screen, passing an air current upwardly through the screen to raise the lighter particles, and vibrating the screen to advance the heavier particles toward an upper end of the screen while the lighter particles float downwardly on a film of air.

In one embodiment of the invention, the entire residual fraction from the second separation procedure is subjected to the third separation procedure. In another embodiment of the invention, an intermediate residual fraction is formed during the second separation procedure, and a fraction of smaller tobacco particles is removed therefrom.

The tobacco particles recovered in the separation procedures are sent to a reconstitution plant. The residual fraction from the third separation procedure is discarded.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
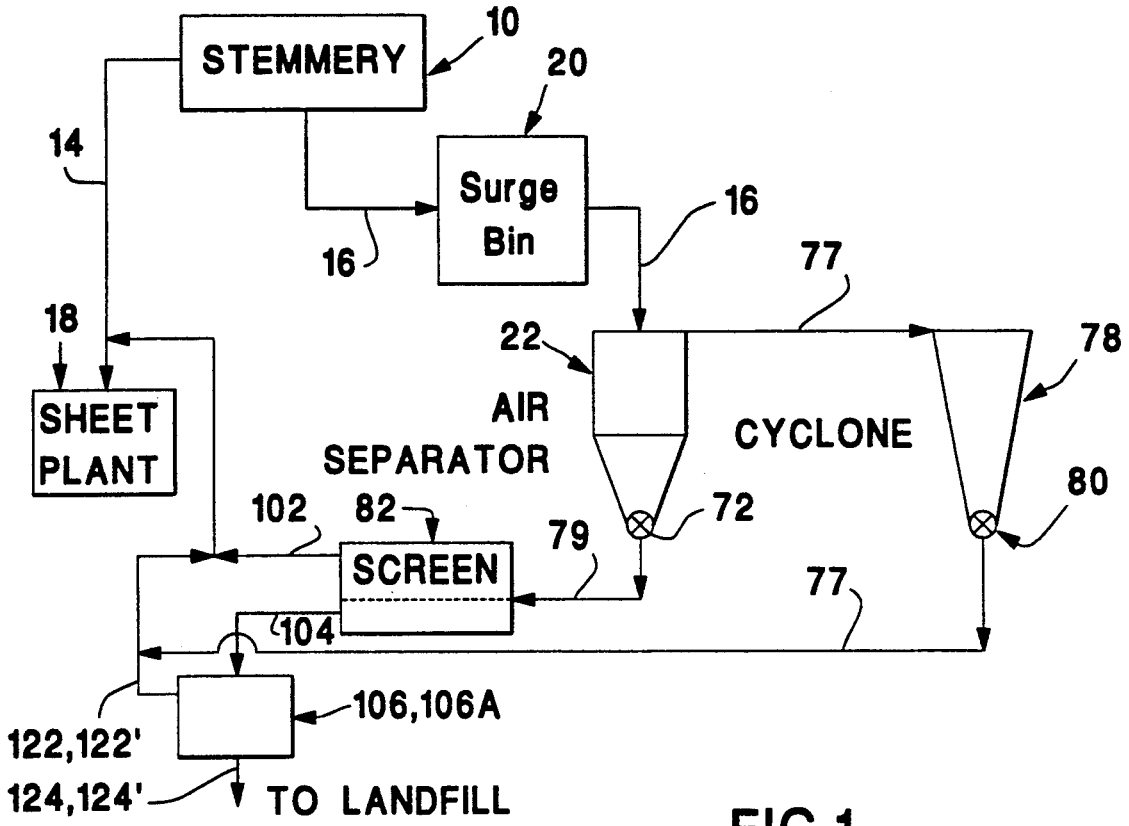
FIG. 1 is a block diagram depicting the stages of separation performed in accordance with the present invention.

Depicted in FIG. 1 is a stemmery facility 10 in which tobacco leaves are subjected to a threshing action. The resulting tobacco fines or particles, together with soil particles (e.g., sand and dirt) undergo a series of screening steps, e.g., by means of conventional vibratory, reciprocal screens, which recover the larger tobacco particles. The thus-recovered tobacco particles 14 are delivered, for example, to a reconstitution plant 18 where they are used in part as fed stock for sheet material.

The residual material 16 from the final screening step, commonly referred to as "stemmery discard", is comprised of very small tobacco particles and the bulk of the original soil (i.e., sand and dirt) which accompanied the leaves to the stemmery. In accordance with the present invention, that residual material is not sent to landfill, as in the prior art, but rather is further treated in accordance with the present invention for the recovery of appreciable amounts of usable tobacco therefrom.

As will be explained in greater detail below, the stemmery discard 16 is subjected to a first separation stage to recover a fraction of smaller tobacco particles, accompanied by only a small amount of soil particles (e.g., 0–20% soil particles by weight). That recovered material is sent to the reconstitution plant.

The residual fraction of the stemmery discard is then subjected to a second separation stage to recover a fraction of larger tobacco particles, accompanied by only a small amount of soil particles, e.g., 0–20% soil particles by weight. The thus-recovered material s sent to the sheet plant.

The residual fraction from the second separation stage (or alternatively only a fraction of larger particles from that residue) is subjected to a third separation stage in which tobacco particles are recovered in such an amount as to be accompanied by only a small amount of soil particles, i.e., 0–20% by weight.

Those recovery steps are performed continuously by means of interconnected separation units.

Turning now to a more detailed description of the separation system, the stemmery discard 16 is initially sent to a surge bin 20 where it accumulates in order to be capable of being discharged as a continuous flow to an air/centrifugal separator 22.

This air/centrifugal separator 22 preferably comprises a conventional/centrifugal air separator manufactured by Sturtevant Inc. of Boston, Mass., and sold under the name Superfine Air Separator.

Figure 2:
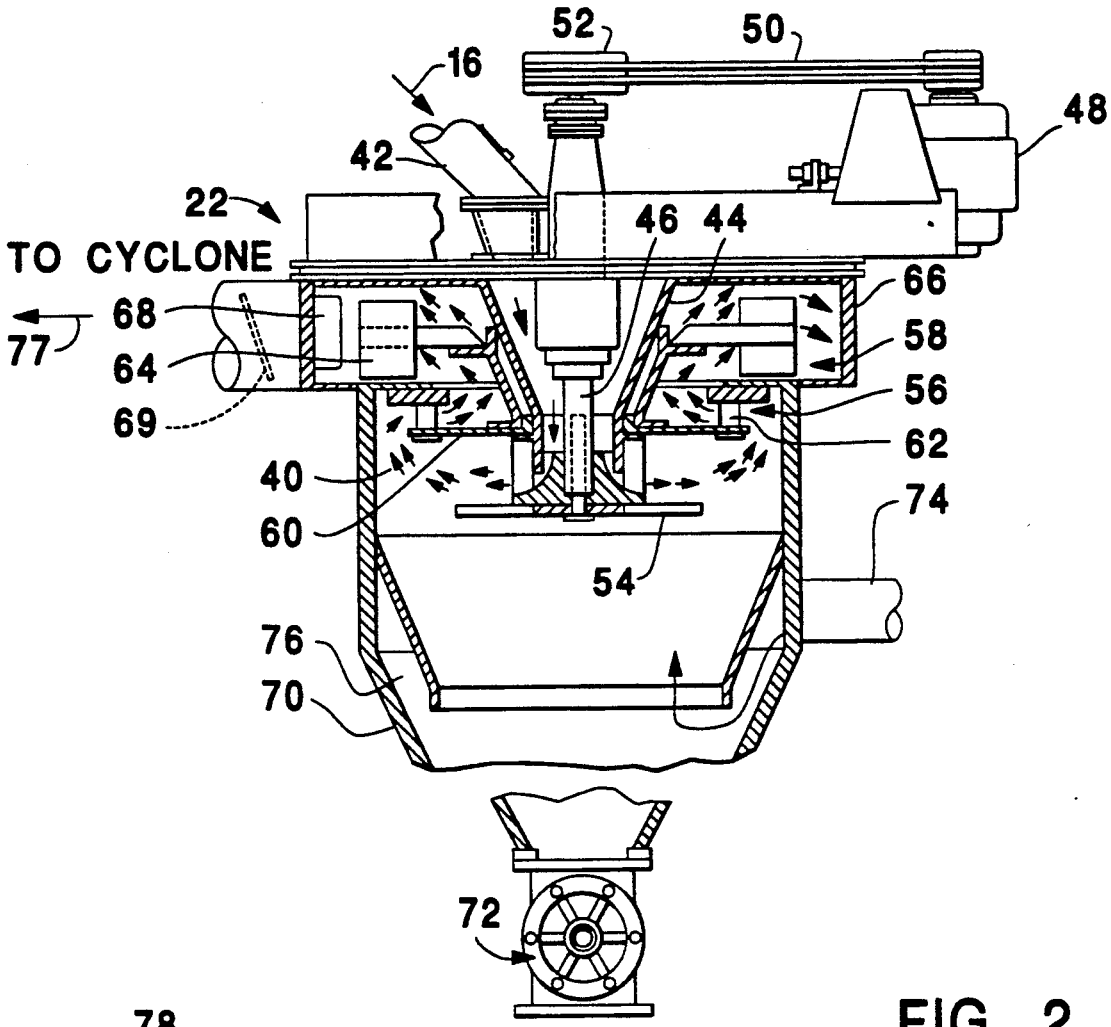
FIG. 2 is a vertical sectional view taken through an air/centrifugal separator in which a first separation stage is performed in accordance with the present invention.
Figure 3:
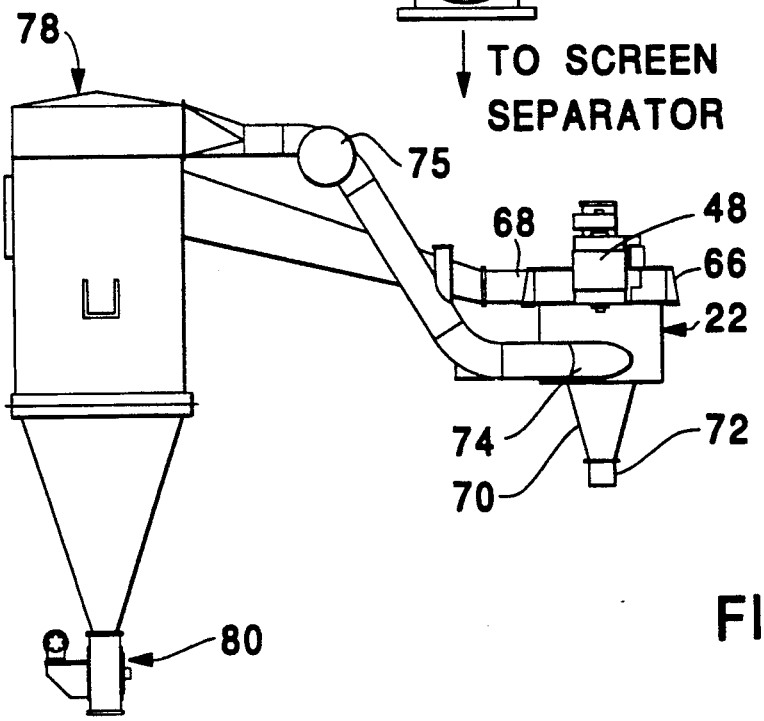
FIG. 3 is a side elevational view of the air/centrifugal separator depicted in FIG. 2 connected to a cyclone separator.

That air/centrifugal separator 22, depicted in FIGS. 2 and 3, includes a separation chamber 40 having a cylindrical portion to which the stemmery discard 16 is continuously fed via a materials inlet 42. That inlet 42 communicates with the top of an infeed cone 44 which opens downwardly into the separation chamber. Extending vertically downwardly through the infeed cone 44 is a shaft 46 which is rotated by a variable speed motor 48 via a belt 50 and pulley 52.

Affixed to the lower end of the shaft 46 is a distributor plate 54 which is rotated by the shaft. Affixed to the distributor plate for rotation therewith are a rotary rejector member 56 and a rotary fan 58. The rejector member 56 is disposed above the distributor plate and comprises a base plate 60 on which are mounted vertically oriented, circumferentially spaced-apart rejector blades 62 that are capable of adjustment for enlarging or reducing the gaps between adjacent blades.

The fan 58 is disposed above the rejector member 56 and comprises a plurality of vertically oriented, circumferentially spaced apart fan blades 64. Surrounding the fan 58 is a circumferential channel 66 having a tangential outlet 68 which includes a valve 69.

A bottom section of the air separator comprises a tailings cone 70 which terminates at its lower end in a rotary valve/air lock 72. A tangential air inlet duct 74 communicates with a space 76 formed between the tailing cone 70 and a lower conical portion 70 of the separation chamber 40. A blower 75 (see FIG. 3) is mounted in the air inlet duct 74 to augment the action of the fan 58.

In operation, the motor 48 rotates the rotary unit comprised of the distributor plate 54, the rejector member 56, and the fan 58. The fan 58 and blower 75 establish an air current from the air inlet duct 74. That air current circulates upwardly through the rejector member 56 and fan 58 before exiting through the outlet 68.

The stemmery discard 16 is fed continuously through the materials inlet 42 and downwardly through the infeed cone 44 to the rotating distributor plate 54. That plate 54 flings the material centrifugally outwardly to establish an even distribution of the material to the upward air current. Heavier tobacco and soil particles move quickly away from the distributor plate and are acted upon by gravity, causing those heavier particles to settle in the tailings cone.

The lighter tobacco and soil particles are carried upwardly in the air stream toward the rejector member 56 which develops a centrifugal force field permitting only smaller particles entrained in the air current to pass through. By regulating the speed of the rejector member 56 (via the motor 48) and the velocity of the air current (e.g., by adjusting the orientation of the rejector blades 62), the separator 22 can be adapted to permit only the fraction of smaller tobacco particles, i.e., no larger than about 150 mesh (most preferably no larger than about 170 mesh), to pass through the rejector member and outlet 68, along with only a small amount of sand, i.e., 0–20% and most preferably 0–8% by weight.

The actual rejector speed and air current speed may vary, depending upon the composition of the particular stemmery discard being treated. In one test run, successful results were obtained by rotating the rejector member at 1800 rpm, circulating the air at 1360 cfm, and infeeding stemmery discard at a rate of 1000 lb/hr. However, it should be appreciated that those parameters will vary, depending upon the nature of the stemmery discard being treated, especially the soil content thereof which can vary appreciably from one run to another.

The thus-recovered tobacco and soil particles 77 are delivered from the outlet 68 to a conventional cyclone separator 78 (see FIG. 3), or alternatively to a bag house separator, which separates the recovered particles from the air current. The air current is then directed back to the air/centrifugal separator 22 via the duct 74, and the recovered tobacco and soil particles are removed from a bottom outlet 80 of the cyclone and delivered to the sheet plant 18 (see FIG. 1).

The residual fraction 79 of the stemmery discard, i.e., tobacco particles larger than about 150 mesh, together with the remaining soil particles, is continuously fed from the valve 72 to the next separation stage where it is subjected to separation in a screen separator 82.

Figure 4:
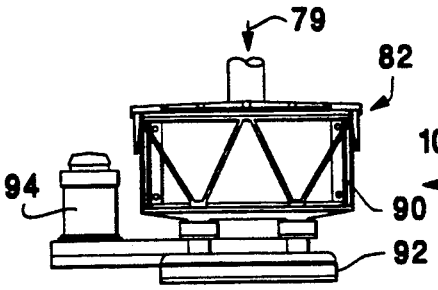
FIG. 4 is an end view of a rotary screen separator in which a second separation operation is performed in accordance with the present invention.
Figure 5:
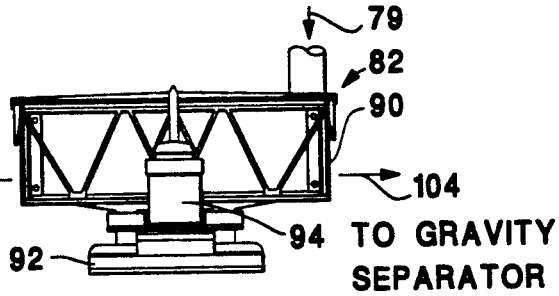
FIG. 5 is a side elevational view of the separator depicted in FIG. 4.
Figure 6:
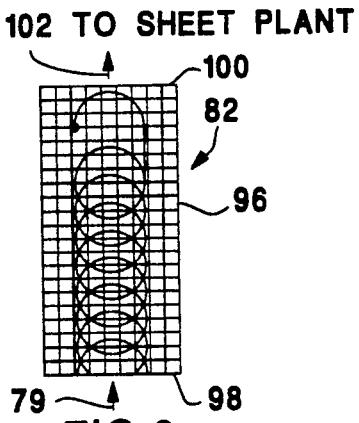
FIG. 6 is a schematic view of a rotary screen component of the separator depicted in FIG. 4 and illustrating the manner in which particles are fed along that screen.

The screen separator 82 is preferably a rotary, non-vibratory screen separator, such as a Series 460MD atmospheric sifter manufactured by the Gump division of Blaw-Knox Food & Chemical Equipment Co., Buffalo, N.Y. That separator, depicted in FIGS. 4–6, comprises a box or bin 90 which is mounted on a base 92 and operably connected to a motor 94 equipped with an adjustable V-belt drive. Disposed inside the box 90 is at least one screen 96. The mixture 79 of tobacco and soil particles is fed onto an inlet end 98 of the screen 96, and the motor 94 drives the screen in a rotating fashion (without appreciable vibration) so as to cause the tobacco and soil particles to travel along the screen 96 in a rotary pattern, as shown schematically in FIG. 6.

The screen is sized to recover a fraction of larger tobacco particles along with a small amount of sand, i.e., 0–20% and most preferably 0–8% by weight. For example, the screen could be a 40 mesh screen to recover (i.e., retain) particles larger than 40 mesh, or more preferably a 30 mesh screen to recover particles larger than 30 mesh. The recovered particles travel to a discharge end 100 of the screen 96 where they are either removed from the box 90 or transferred to one or more downstream screens for at least one additional screening pass. Eventually, a stream 102 of the recovered particles travels out of the box (see FIG. 1) and is further processed into a tobacco product, e.g., at the sheet plant 18.

The recovery of tobacco particles in the screen separator 82 is facilitated by the earlier separation of the very small tobacco particles in the air/centrifugal separator 22. That is because those very small particles tend to clog or blind screen separators, requiring that the separation process be interrupted to enable the screen to be cleaned. Hence, the separation process can proceed continuously.

Figure 7:
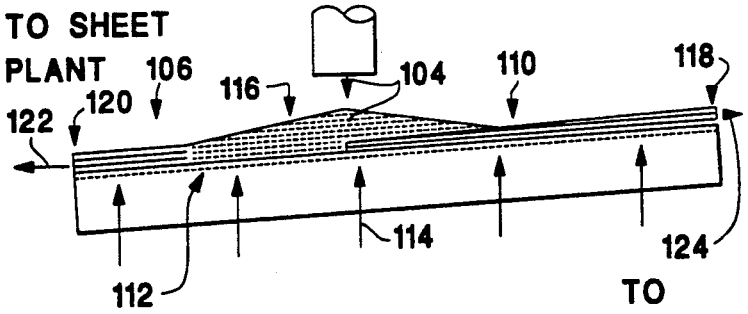
FIG. 7 is a schematic side elevational view of a vibratory gravity separator in which a third separation step is performed in accordance with the present invention.
Figure 8:
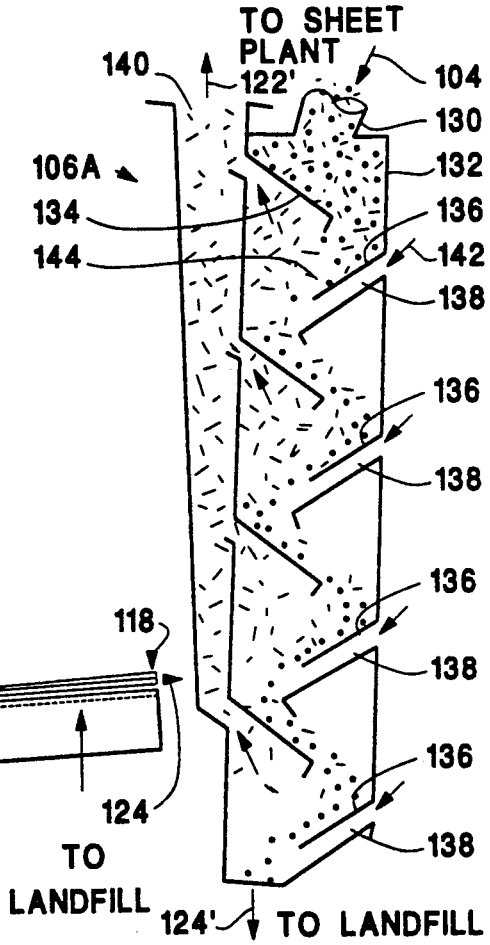
FIG. 8 is an air type gravity separator which may be utilized in lieu of the separator depicted in FIG. 7.

The residual fraction 104 which passes through the screen(s) of the screen separator, e.g., tobacco particles from about 40 mesh to about 150 mesh in size, plus the remaining soil particles, is fed continuously to a gravity separator 106 (see FIG. 7) or 106A (FIG. 8).

The gravity separator 106 may comprise a vibratory gravity separator such as an Oliver Stoner Model No. 6048, manufactured by the Oliver Manufacturing Co. Inc. of Rocky Ford, Colo. That separator 106, depicted schematically in FIG. 7, comprises an inclined separator deck 110, the surface 112 of which is a screen mesh. An air current, represented by arrows 114, is directed upwardly through the screen, and the deck is simultaneously vibrated. The residual fraction 104 is deposited onto a stratification zone 116 of the screen 112. The lifting action of the air current and the vibration of the screen combine to stratify the deposited material into layers, with the heavier particles (mostly soil) on the bottom, and lighter particles (most tobacco) on the top. The vibration of the deck causes the heavier particles in contact with the screen to travel uphill toward an upper soil discharge end 118 of the deck. The lighter particles, which do not contact the screen, float downwardly on a film of air toward the discharge end 120 of the deck. A stream 122 of recovered particles is recovered and delivered to the sheet plant 18, and a residual stream 124 of primarily soil particles is removed and taken to landfill.

The separator 106 or 106A is not operated in a manner for recovering tobacco particles of a selected size, but rather for recovering as many tobacco particles as possible without exceeding a selected soil content (e.g., between 0–20% and most preferably 0–8% by weight). In other words, the operation of the separator 106 (and 106A) is controlled so as to recover as much tobacco as possible without exceeding a given soil content. In one successful run, the screen was inclined at about 5 degrees; the eccentric deck speed was 580 rpm; and the air velocity was 200 fpm.

The separation of particles in this gravity separator 106 or 106A is greatly facilitated by the prior recovery of the fractions of smallest and largest particles in the separators 22 and 82, respectively. That is because the gravity separator 106 or 106A separates particles on the basis of density, and thus prefers that the particles not be of a wide range of sizes.

An alternative type of gravity separator 106A is depicted in FIG. 8. That gravity separator 106A is a multi-aspirator manufactured by Kice Industries, Inc. of Wichita, Kans. In that separator, the residual fraction 104 from the screen separator 82 is fed continuously into an upper inlet port 130 of a housing 132 and cascades down a series of inclined left-hand and right-hand slides 134, 136. Alternating ones of the slides, i.e., the right-hand slides 136, are situated above respective air inlets 138. A suction generated at a tobacco outlet 140 of the housing 132 causes air (represented by arrows 142) to be sucked through the air inlets 138. As the material 104 falls off the lower edges of the right-hand slides 136, it is contacted by an upwardly flowing, high velocity air current. This tends to lift all particles, but due to the expanding shape of the suction spaces 144 located above the edge of the slides 136, the air velocity slows, and the soil particles (which are typically heavier than the tobacco particles), drop onto the next lower left-hand slide 134. The lighter particles (mostly tobacco) are lifted through the spaces 144 and fly with the suction air to the tobacco outlet 140. The soil particles 124' exit through a soil particle outlet and are sent to landfill. The tobacco particles exiting through the tobacco outlet 140 are processed into a tobacco product, e.g., at the sheet plant 18.

As in the case of the separator 106, the separator 106A is operated so as to recover as much tobacco as possible without exceeding a preselected soil content (e.g., 0–20% and most preferably 0–8%, by weight).

The afore-mentioned advantages ensuing from the prior recovery of the fractions of smallest and largest particles in the separators 22, 82 in connection with the gravity separator 106 also apply to the gravity separator 106A. In order to even further minimize the size range of the particles received from the screen separator 82, that separator can be operated to remove (for discard) a smaller fraction of the particles, as will be explained in connection with FIG. 9.

Figure 9:
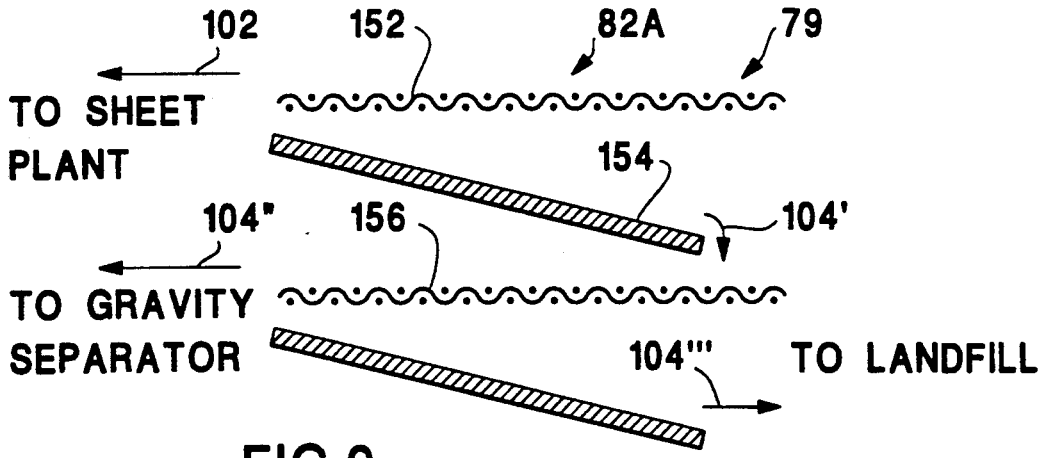
FIG. 9 is a schematic side view of an alternative screening arrangement of the rotary screen separator depicted in FIG. 4.

Depicted in FIG. 9 is a variation of the separation procedure performed in the rotary screen separator wherein the size range of the particles in the residual fraction fed to the gravity separator is reduced by separating out and discarding the particles at the small end of the size range, i.e., particles smaller than about 100 mesh. As noted earlier, a gravity separator functions more efficiently if the size range of the particles is minimized.

The modified rotary screen conveyor 82A comprises a first screen 152 (e.g., a 40 mesh screen) which recovers the larger-than-40 mesh fraction of tobacco from the residual fraction received from the air/centrifugal separator 22. (That screen 152 would correspond to the 40 mesh screen 96 described earlier in connection with FIGS. 4–6.) The particles passing through the screen 152, i.e., an intermediate residual fraction 104' of 40–150 mesh particles, fall onto a slide 154 and travel onto the inlet end of a second screen 156, e.g., a 100 mesh screen. The second screen 156 separates out and recovers the particles 104'' larger than 100 mesh which are then fed to the gravity separator 106 or 106A. The 100–150 mesh particles 104''', together with the sand content thereof which fall through the screen 156, is discarded and sent to landfill.

In sum, of the residue 104' passing through the screen separator 152, the fraction of larger particles 104'' is continually fed to the gravity separator 106 (or 106A), and the fraction of smaller particles 104''' is sent to landfill. Hence, the separator 106 or 106A receives a residual fraction 104'' having tobacco particles in the range of about 40 to 100 mesh, as compared with a range of about 40 to about 150 mesh in the earlier-described embodiment. Also, the residual fraction 104'' contains less soil, due to the separation by screen 156.

It will be appreciated that in accordance with the present invention, a substantial amount of tobacco in stemmery discard, which previously would have been sent to landfill, is now recovered for use in tobacco products. Hence, less tobacco is wasted, and the depletion of landfill space is reduced.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A method of recovering tobacco particles from stemmery discard comprised of tobacco particles and soil particles, comprising the steps of:

A) subjecting the stemmery discard to a first separation procedure for recovering a fraction of smaller tobacco particles with a soil content in the range of about 0–20 percent by weight;

B) subjecting the residual fraction from the first separation procedure to a second separation procedure for recovering a fraction of larger tobacco particles with a soil content in the range of about 0–20 percent by weight; and C) subjecting at least a fraction of larger particles of the residual fraction from the second separation procedure to a third separation procedure for recovering tobacco particles with a soil content in the range of about 0–20 percent by weight.

2. A method according to claim 1, wherein Step B includes, subsequent to recovering the fraction of larger tobacco particles, separating-out and discarding a fraction of smaller tobacco particles.

3. A method of treating stemmery discard comprised of tobacco and soil particles, for the recovery of tobacco particles therefrom, comprising the steps of:

A) subjecting the stemmery discard to a first separation procedure for recovering therefrom tobacco particles smaller than about 150 mesh and containing no more than about 20% soil particles by weight;

B) subjecting the residual fraction from the first separation procedure to a second separation procedure for recovering therefrom tobacco particles larger than about 40 mesh and containing no more than about 20 percent soil particles by weight; and C) subjecting at least the larger particles of the residual fraction from the second separation procedure to a third separation procedure for recovering therefrom tobacco particles containing no more than about 20 percent soil particles by weight.

4. A method according to claim 3, wherein tobacco particles smaller than about 170 mesh are recovered in Step A.

5. A method according to claim 4, wherein tobacco particles larger than about 30 mesh are recovered in Step B.

6. A method according to claim 3, wherein the residual fraction from Step B which is subjected to Step C contains tobacco particles in the range of about 40 to about 150 mesh.

7. A method according to claim 3, wherein the residual fraction from Step B which is subjected to Step C contains tobacco particles in the range of about 40 to about 100 mesh.

8. A method according to claim 3, wherein tobacco particles recovered in steps A, B and C are incorporated into a tobacco product.

9. A method according to claim 8, wherein tobacco particles recovered in steps A, B, and C are sent to a reconstitution plant and formed into the shape of a sheet.

10. A method according to claim 9, wherein the residual fraction from Step C is discarded.

11. A method according to claim 3, wherein Step A comprises introducing the stemmery discard into an upward air current and passing the air current through a centrifugal force field.

12. A method according to claim 11 including the step of forming the centrifugal force field by rotating a bladed rejector member about a vertical axis, the air current being passed through the blades.

13. A method according to claim 11, wherein Step B comprises placing the residual fraction from the first separation procedure onto a screen separator.

14. A method according to claim 13, wherein the screen comprises a rotary screen which advances particles with a circular motion without appreciable vibration.

15. A method according to claim 13, wherein Step C comprises placing the residual fraction received from the second separation procedure onto an inclined screen and passing an air current upwardly through the screen to raise the lighter particles, and vibrating the screen to advance the heavier particles toward an upper end of the screen while the lighter particles float downwardly on a film of air.

16. A method according to claim 13, wherein Step C comprises cascading the residual fraction received from the second separation procedure sequentially down a plurality of inclined slides while subjecting such residual fraction to an upward air current upon falling off at least two of the slides.

17. A method according to claim 3, wherein Step B comprises placing the residual fraction received from the first separation procedure onto a screen separator.

18. A method according to claim 3, wherein Step C comprises placing the residual fraction received from the second separation procedure on an inclined screen and passing an air current upwardly through the screen to raise the lighter particles, and vibrating the screen to advance the heavier particles toward an upper end of the screen while the lighter particles float downwardly on a film of air.

19. A method according to claim 3, wherein Step C comprises cascading the residual fraction received from the second separation procedure sequentially down a plurality of inclined slides while subjecting such residual fraction to an upward air current upon falling off at least two of the slides.

20. A method according to claim 3, wherein following recovery of tobacco particles larger than about 40 mesh in Step B, there remains an intermediate residual fraction having tobacco particles between about 40 and 150 mesh, and thereafter separating-out and discarding a portion of the smaller particles from the intermediate residual fraction before sending the residue of the intermediate fraction to Step C.

21. A method according to claim 20, wherein the smaller portion of the particles which are separated out from the intermediate residual fraction are particles smaller than about 100 mesh.

22. A method according to claim 21, wherein Step B comprises introducing the residual fraction received from Step A onto a first screen for the recovery of the tobacco particles larger than about 40 mesh, and introducing the intermediate residual fraction onto a second screen to separate out the portion of smaller particles therefrom.

* * * * *